United States Patent [19]

Shih et al.

[11] Patent Number: 4,813,788

[45] Date of Patent: Mar. 21, 1989

[54] STATIC, GRAVITY-FLOW MIXING APPARATUS FOR PARTICULATE MATTER

[75] Inventors: Chien-Cheng Shih, Irvine; Darcel L. Hulse, Laguna Nigel; Walter Albertson, Brea, all of Calif.

[73] Assignee: Union Oil Company of California, Los Angeles, Calif.

[21] Appl. No.: 815,914

[22] Filed: Jan. 3, 1986

[51] Int. Cl.[4] ..... B01F 5/24; G10B 39/00

[52] U.S. Cl. ..... 366/337; 202/227

[58] Field of Search ..... 366/336, 337, 338, 339, 366/340; 138/38, 42; 48/180.1; 202/95, 227

[56] References Cited

U.S. PATENT DOCUMENTS

| | | | |
|---|---|---|---|
| 1,574,210 | 2/1926 | Spaulding | 366/340 X |
| 2,345,554 | 4/1944 | Burdett | 366/337 X |
| 3,045,984 | 7/1962 | Cochran | 366/340 |
| 3,275,304 | 9/1966 | Brundrett | 366/337 |
| 3,337,194 | 8/1967 | Zavasnik et al. | 366/337 |
| 3,395,898 | 8/1968 | Westelaken | 366/337 X |
| 3,988,211 | 10/1976 | Lewandowski et al. | 202/227 |
| 4,207,009 | 6/1980 | Glocker | 366/340 X |
| 4,437,936 | 3/1984 | Jung | 202/227 X |
| 4,556,458 | 12/1985 | Deering et al. | 202/227 |

FOREIGN PATENT DOCUMENTS

| | | | |
|---|---|---|---|
| 6014 | 5/1907 | United Kingdom | 366/338 |
| 581849 | 10/1946 | United Kingdom | 366/337 |

OTHER PUBLICATIONS

*Handbook of Fastening and Joining of Metal Parts*, V. H. Laughner and A. D. Hargan, McGraw-Hill Book Company, Inc., New York, 1956, pp. vii, viii, 234, 329 (cont.), 353, 355, 438, 444, 450, 463, 614.

"Parachute Creek Shale Oil Program", Union Oil Company of California (date unknown).

"In-Bin Blending", J. R. Johanson, Chemical Engineering Process, vol. 66, No. 6, pp. 50–55 (date unknown).

"Controlling Flow Patterns in Bins by Use of an Insert", J. R. Johanson, Bulk Solids Handling, vol. 2, Sep. 1982, pp. 495–498.

"The Use of Flow-Corrective Inserts in Bins", J. R. Johanson, Transactions of the aSME, May 1966, pp. 224–230.

"An Overview of Oil-Shale Retorting Processes", Arthur Lewis Energy Research, pp. 1–15 (date unknown).

"LPD Motionless Mixer", Charles Ross and Sons Company, Long Island, New York (date unknown).

U.S. Ser. No. 115,165 filed 10/30/87 entitled Mixing and Cooling Apparatus for Hot, Particulate Matter (U.S. Pat. No. 4,746,222).

*Primary Examiner*—Harvey C. Hornsby
*Assistant Examiner*—Scott J. Haugland
*Attorney, Agent, or Firm*—Gregory F. Wirzbicki; Howard R. Lambert

[57] ABSTRACT

Gravity flow mixing apparatus for the packed bed flow mixing of particulate matter, such as hot, retorted oil shale, comprises a mixing tower having therein a plurality of parallel mixing tubes. A plurality of three dimensional mixing members are axially spaced apart at about 60° to about 120° rotational separation so that, with packed bed flow through the tubes, each member is below the particulate matter repose surface at the above-adjacent member. Means are included for introducing a cooling fluid, preferably, water, into the tubes just above one or more of such repose surfaces, apertures being provided in the tubes to enable disengagement of gases, for example, steam, from the particulate matter. Comprising each mixing member are primary, secondary and tertiary mixer elements. The primary element has a "W" shaped free edge and the secondary and tertiary elements each have first and second triangular sides connected together to form a linear peak and define a tetrahedral shape, the tertiary element being substantially smaller than the secondary element. The secondary element is joined to the primary element so that the secondary element projects upwardly and outwardly from the primary element. In turn, the tertiary element is joined to the secondary element so that the linear peaks of each meet at an obtuse angle, the tertiary element thereby projecting forwardly and outwardly from the secondary element at upper regions thereof. Corresponding mixing methods are provided.

45 Claims, 4 Drawing Sheets

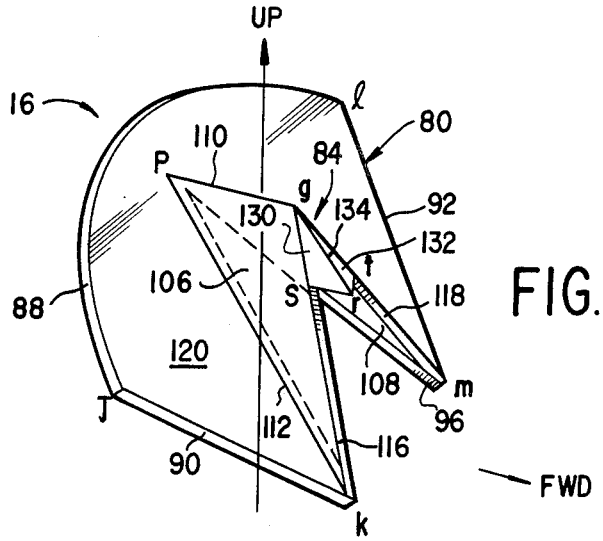
FIG. 7
FIG. 6
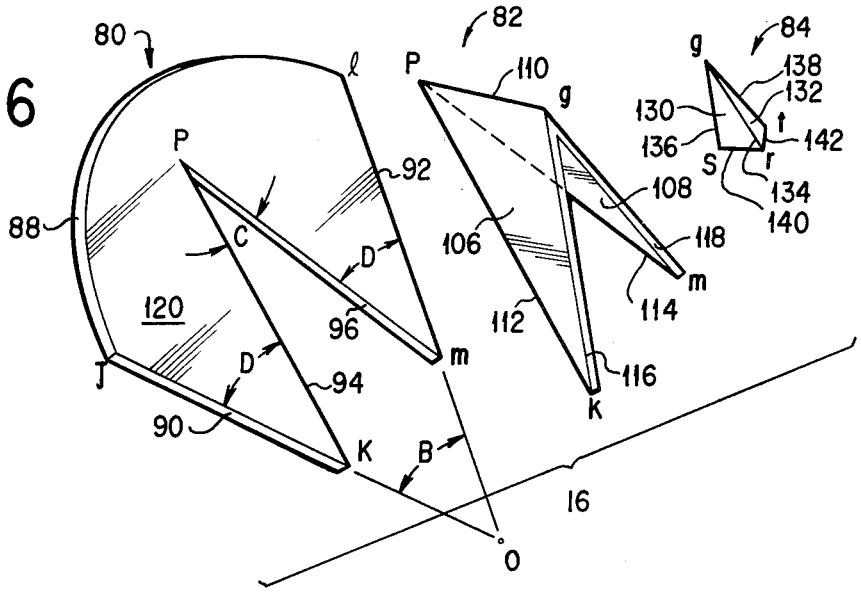
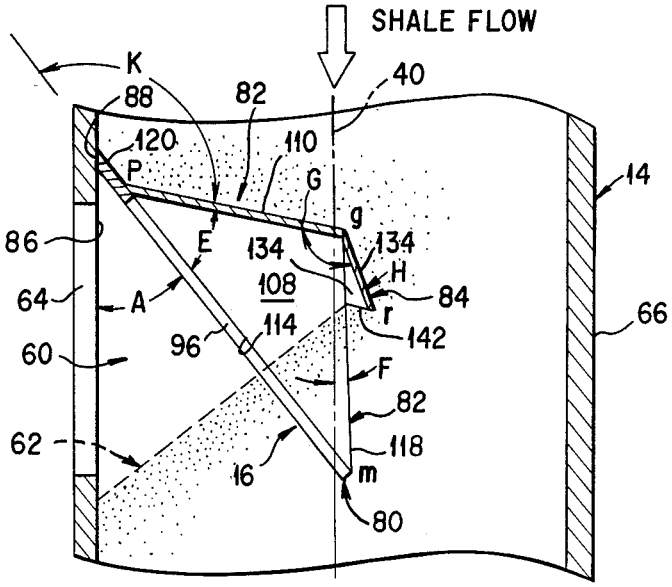
FIG. 5

STATIC, GRAVITY-FLOW MIXING APPARATUS FOR PARTICULATE MATTER

BACKGROUND OF THE INVENTION

1. Field of the Invention:

The present invention relates generally to the field of tube-type, gravity-flow mixing apparatus for particulate matter, particularly, retorted oil shale.

2. Discussion of the Prior Art:

Organic-rich shales (oil shales), which are found on every continent in sediments ranging in age from Cambrian to Tertiary, represent a vast source of fossil fuel. Oil shales capable of producing from 25 to 100 barrels of oil per ton of shale have recently been estimated to represent an oil reserve of about $9\times10^{11}$ barrels. If all oil shales capable of producing between 5 and 100 barrels of oil per ton are considered, the oil reserve estimate is increased to about $5.5\times10^{12}$ barrels. By way of comparison, the estimate of the world's 1975 crude oil reserve was $7\times10^{11}$ barrels.

Oil shale underlies an estimated 20 percent of the land mass of the United States. So far as is presently known, the world's largest single oil shale reserve is in the Eocene Green River Formation which spans the states of Colorado, Utah and Wyoming. The Green River Formation, which covers about 16,500 square miles, is estimated to have an oil potential in excess of about $2\times10^{12}$ barrels. Of this amount, about $6\times10^{11}$ barrels are estimated to reside in deposits which are relatively producible and which yield 25 or more barrels of oil per ton of shale, an amount representing about 20 times the present estimate of this country's crude oil reserves.

It is also very important that of all the alternative oils, shale oil most closely resembles crude oil; for example, shale oil contains fewer impurities and more hydrogen than synthetic oil made from coal. Also, using present technologies, a suitable refinery feedstock can be produced from shale oil more economically than from other alternative oils.

In spite of the vast potential of the world's oil shales, the commercial production of shale oil has generally, due to high production costs, been uneconomical as compared to the cost of crude oil. Consequently, it is usually only in special circumstances, as when other fuels have been in short supply or when normal channels of crude oil transportation have been disrupted, that the extraction of oil from shale is carried out commercially. Although fairly substantial amounts of oil were produced from shale in Europe in the late 1800's and the early 1900's, the availability of low cost crude oil from the Near East and improved means of oil transportation halted most of such shale development until World War II, when the demand for oil sharply increased and the production and distribution of petroleum was disrupted. Thus, during World War II, significant amounts of shale oil were produced by Germany, France, the Soviet Union and many other countries. However, after the War, cheap crude oil again became plentiful and interest in the production of oil shale correspondingly declined once more. More recently, in the mid-1970's when Near East crises and the formation of strong oil cartels drove the cost of crude oil up sharply and oil embargos were imposed, interest in oil shale was, however, again reawakened.

It is obvious that the balance between energy supply and energy demand has in the past controlled the position of oil shale in the energy market. As long as the cost of shale oil exceeds the cost of crude oil by substantial amounts, as has usually been the case, the development of oil shale will be inhibited, unless factors other than cost, such as national interest in self-sufficiency in oil, becomes more important than the cost differential between shale and oil and crude oil.

However, in the absence of critical crude oil shortages or overriding national interests, reducing the costs associated with the production of shale oil is paramount to the continued development of oil shale reserves.

For many reasons, the production of oil from shale has remained costly. One reason is that large amounts of shale are required to produce even relatively small amounts of shale oil. For example, the a production of 10,000 barrels of oil a day from Green River oil shale may require the processing of about 12,500 tons of high grade shale a day, all of which must be mined in an environmentally acceptable manner. After being mined, the shale must typically be crushed into pieces no larger than about two inches; however; because of the high organic content of the shale crushing is difficult. Thereafter, the crushed shale must be retorted at a high temperature to decompose kerogen in the shale into raw shale oil. Typically, retort temperatures in the range of 700° F. to 100° F. are used in order to produce high grade oil which is almost completely aromatic with little olefin or saturate content. To be practical, such retorting must generally be done in a continuous flow manner, upflow retorts, in which the crushed shale is introduced into the bottom of the retort and retorted shale is discharged from the top, being a known apparatus for this purpose.

Significant costs are also associated with the disposal of the retorted shale, which, by weight, usually amounts to about 80 percent of the mined shale. It is to problems associated with the disposal of retorted shale that this present invention is principally directed.

A substantial difficulty with the disposal of retorted shale is that such shale still contains some residual amounts of carbon. If, therefore, the retorted shale is discharged directly into an atmospheric environment at retort temperatures, the retorted shale may spontaneously combust (assuming the retort temperature is in excess of about 500° F.). For environmental and practical reasons such shale combustion in the atmosphere is undesirable and may, in fact, be unlawful in many localities. Consequently, provision is generally made for cooling the retorted shale before it is discharged for land fill, other use or disposal. For safe discharge into an atmospheric environment, the retorted shale must generally be cooled to under about 400° F., as for example, in one or more vertically oriented gravity-flow cooling vessels. Retorted shale is discharged from the retort directly into the top of the cooling vessels, through which the retorted shale flows downwardly under gravity, usually in a packed bed flow. The shale is discharged from the bottom of the vessels cooled to a non-spontaneously combusting temperature. Also, water is typically sprayed onto the retorted shale as it descends through the vessels to effect the cooling process.

Retorted shale cooling vessels known to the present inventors, however, are generally deficient in that little or no shale mixing is provided and the cooling water cannot penetrate into the center of the shale flow. As a result, pockets of uncooled shale tend to become entrained in the flow of shale through the vessels. Similarly, after water injection to cool the shale, pockets of water or overwetted shale particles tend to become entrained in the shale flow. When, as frequently occurs, pockets of uncooled shale encounter pockets of water or over-wetted shale, the water violently flashes into steam, thereby causing a localized explosion in the vessels. These explosions disrupt the flow of retorted shale through the vessels and may, by the back pressure caused by the explosions, disrupt operation of the retorts which supply shale to the vessels. Even if the pockets of uncooled shale entrained in the shale flow do not encounter pockets of water or over-wetted shale, when discharged from the vessels, these uncooled shale pockets may spontaneously combust in the air. Furthermore, if the shale cooling water is not well mixed into the shale flow, the resulting localized regions of overwetted shale may cause bridging in the discharge conduits, shale flow through the vessels may be restricted and cooling may be further impeded. Still further, the use of large amounts of water to cool the retorted shale increases the cost of shale disposal and may deplete local sources of water at an excessive rate—a problem of particular severity in the many arid regions of the western United States in which oil shale is abundant.

Problems associated with proper cooling of the retorted oil shale are caused, at least in part, by the great variation in particle size present in the retorted shale. These particle sizes may range from the maximum crush size of about 2 inches to very fine powder. Not only is the homogeneous mixing of materials having such a wide particle size range by static, gravity flow very difficult, but the very fine, powdery particles tend to inhibit the wetting of larger particles by the cooled water sprays.

It can thus be seen that improvements to retorted oil shale cooling vessels are needed to help reduce the costs of producing oil from oil shade.

An object of the present invention is, therefore, to provide a gravity flow, mixing tube apparatus for mixing particulate matter, the apparatus having a plurality of three dimensional internal, static mixing members configured for providing efficient particulate matter mixing in a comparatively short tube length.

Another object of the present invention is to provide a gravity flow, mixing tube apparatus for mixing and cooling hot particulate matter, such as hot retorted oil shale, the apparatus having a plurality of mixing tubes each having a plurality of three-dimensional, static mixing members and having means for introducing cooling water into the tubes and means for enabling disengagement of steam produced by the water contacting the hot particulate matter from the matter and the tubes.

Still another object of the present invention is to provide a three-dimensional particulate matter mixing member adapted for use in gravity flow, static mixing tube.

Other objects, features and advantages of the present invention will be readily apparent from the following detailed description thereof when taken in conjunction with the accompanying drawings.

SUMMARY OF THE INVENTION

According to the present invention, mixing tower apparatus for the gavity flow mixing of particulate matter, which may be retorted oil shale having a temperature in excess of about 500° F., comprise a plurality of mixing tubes for mixing the particulate matter mounted with the longitudinal axes thereof mutually parallel. Each of the mixing tube means comprises an elongate mixing tube adapted for operation with the longitudinal axis thereof in a vertical orientation and mixing means disposed in the tube for causing the mixing of particulate matter flowing downwardly through the tube, the mixing means including a plurality of three-dimensional mixing members connected at a downward slant angle to the inside of the tube in an axially spaced apart and rotationally offset relationship to one another. Comprising each of the mixing members are a primary mixer element and a secondary mixer element, with the primary mixer element preferably being flat and the secondary mixer element preferably being peaked. The primary mixer element has a generally "W" shaped free surface edge and a mounting edge interconnecting opposite ends of the "W" shaped edge, and the secondary mixer element is of tetrahedral shape having closed first and second triangular sides and open third and fourth sides. The first and second sides of the secondary mixer element are interconnected to form a linear peak. The edges of second sides which define the open fourth side are joined to the primary mixer element along intersecting inner leg portions of the "W" shaped edge so that the secondary mixer element sits on top of the primary mixer elment and the linear peak intersects the upper surface of the primary mixer element at an obtuse peak-to-plate angle, with the linear peak extending away from the tube wall to beyond the tube longitudinal axis. Preferably the peak-to-plate angle is between about 120° and about 150°, with 140° being the more preferred angle.

The apparatus comprises at least three of the mixing tube means, which are arranged around a circle in an equally spaced apart relationship.

The plurality of mixing members includes at least one group of N members, the number N preferably being between 3 and 6. Each member of the group is rotationally offset from the above-adjacent member in the group in a uniform rotational direction by a rotational angle "$\alpha$" which is equal to 360°/N, the members of the group being arranged along a helical path around the inside of the tube. Further included in the plurality of mixing members may be at least one second group of M members, the number M preferably also being between 3 and 6. Each member of the second group is rotationally offset from the above-adjacent member in the same group by a rotational angle "$\beta$" which is equal to 360°/M, the members of the second group being arranged along a second helical path around the inside of the tube beneath the helical path along which the N members are arranged.

It is preferred that the mixing members be equally spaced apart in the tube axial direction, the axial spacing being such that when the tube is vertically oriented and particulate matter is flowed, in a packed bed manner, downwardly through the tube, each of the mixing members is below the particulate matter repose surface associated with the above adjacent one of the mixing members. The mixing members are connected along the mounting edges thereof to the inside of the tube, the slant angle being the angle between the side of the tube and the primary mixing element.

Preferably the slant angle is between about 30° and about 60° and is more preferably about 40°. Also preferably, the sum of the slant angle and the angle between the peak and the plane of the flat primary mixer element is less than about 90°. In an embodiment, the open third side of the secondary mixer element makes an acute side-to-axis angle with the longitudinal axis of the tube which is between about +10° and about −10°. When the mixing members are mounted to the inside of the tube, portions of the "W" shaped edge of the primary mixer elements preferably extend more than halfway across the tube.

To provide cooling of the particulate matter, the apparatus may include means for introducing a liquid into the tube for mixing with the particulate matter flowing downwardly through the tube. The means for introducing liquid, into the tube for mixing with the particulate matter flowing downwardly through the tube. The means for introducing liquid into the tube introduces the liquid through the side wall of the tube below adjacent to at least one of the mixing members and, for packed bed flow, above the particulate matter repose surface associated therewith. When, as is preferred, the cooling liquid is water, there may be included means defining at least one aperture through a side wall of the tube for the escape of steam therefrom, the aperture being located below adjacent at least one of the mixing members and above the particulate matter surface of repose associated with the mixing member.

Referring to the mixing members, an acute inner edge angle at the intersection of the inner edges of the "W" shaped edge of the primary mixer element may be between about 15° and about 45°, the preferred inner edge angle being about 25°. The outer edges of said "W" shaped edge of the primary mixer element preferably intersect the inner edges of the "W" shaped edge at an outer-to-inner edge intersecting angle of between about 20° and about 45°; more preferably, such outer-to-inner edge intersecting angle is about 35°.

According to an embodiment, the mixing member further comprises a peaked tertiary mixer element of tetrahedral shape, the tertiary mixer member being substantially smaller than the secondary mixer element and having closed first and second sides and open third and fourth sides. The first and second sides of the tertiary mixer element are interconnected to form a linear peak and are connected at the open fourth side of the tertiary element to the secondary mixer element first and second sides at the open third side thereof, so as to cause the tertiary mixer peak to project outwardly from the secondary mixer element open third side and the tertiary mixer element linear peak to intersect the secondary mixer element linear peak at a peak-to-peak intersection angle which is greater than about 90°. The preferred peak-to-peak intersection angle between the linear peaks of the secondary and tertiary mixer elements is between about 125° and about 145° and is more preferably about 135°. The length of the tertiary mixer element linear peak may be between about 30% and about 50%, and is preferably about 40%, of the length of the secondary mixer element linear peak. Edges of the tertiary mixer element first and second sides which define the open third side of the tertiary mixer element may make an acute side-to-peak angle of between about 30° and about 60° with the tertiary mixer element linear peak. It is preferred, however, that such side-to-peak angle be about 45°. Corresponding methods for mixing and cooling particulate matter, especially hot, retorted oil shale, are provided.

BRIEF DESCRIPTION OF THE DRAWINGS:

A better understanding of the present invention may be had from a consideration of the following detailed description, taken in conjunction with the accompanying drawings in which:

FIG. 5 is a vertical sectional view taken along lines 5—5 of FIG. 3 showing one of the mixing members in cross-section;

FIG. 6 is an exploded view of the mixing member showing separated primary, secondary and tertiary mixing elements thereof;

FIG. 7 is a perspective drawing of the mixing member showing the joining of the primary, secondary and tertiary mixing portions thereof;

Figure 1:
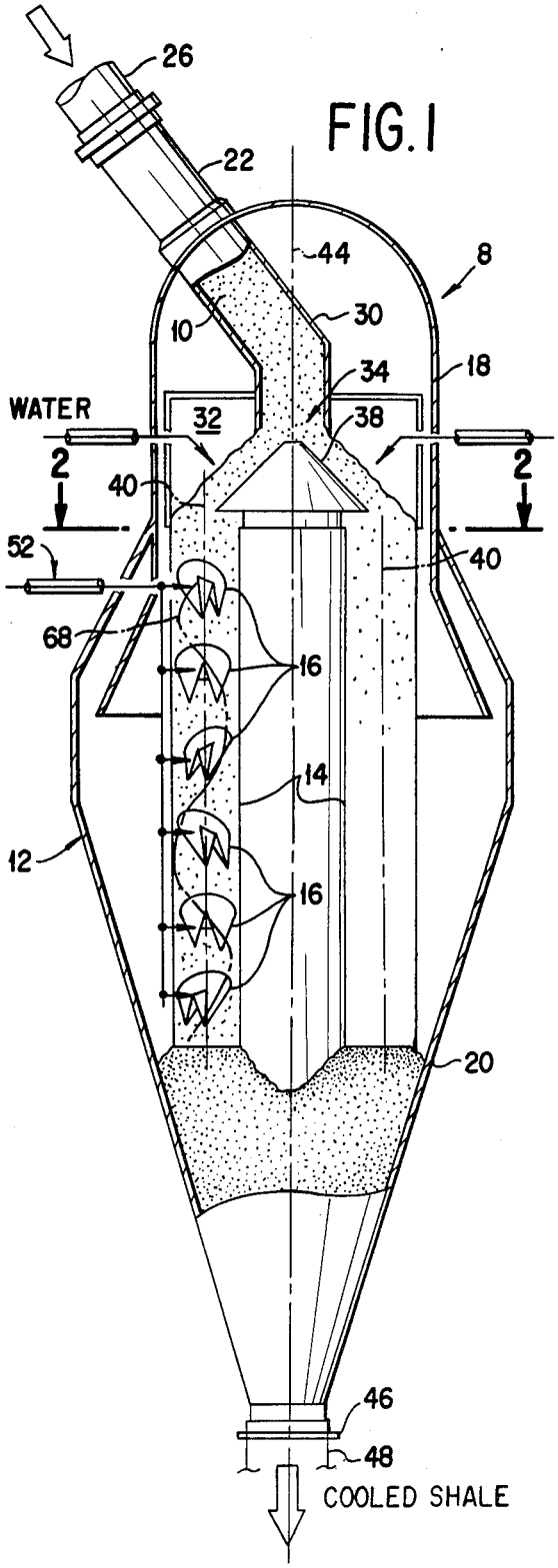
FIG. 1 is a cutaway drawing of an oil shale shaft cooler (cooling tower) apparatus in which the mixing tube apparatus and mixing members of the present invention may be used to advantage.

DESCRIPTION OF THE PREFERRED EMBODIMENT;

Shown in FIG. 1 is a static gravity flow mixing tower (shaft cooler) apparatus 8 for the mixing or mixing and cooling, including gas disengagement, of particulate matter, such as retorted oil shale 10. Generally comprising mixing tower apparatus 8 are a closed shell or housing 12 and a plurality of mixing tubes or mixing tube means 14 which are fixed in a vertical orientation within the housing. A plurality of three dimensional mixing members or means 16 is mounted within each mixing tube 14, the mixing members being mounted in an axially spaced apart and rotationally offset or staggered relationship with one another so that particulate matter 10 flowing downwardly through the tubes descends from one mixing member to another.

For illustrative purposes, mixing tower apparatus 8, mixing tubes 14 and mixing members 16 are shown and described herein as being configured and adapted for the mixing and cooling of hot, crushed and retorted oil shale 10 before the shale is discharged into the open atmosphere for disposal. It is, however, to be understood that apparatus 8, mixing tubes 14 and/or mixing members 16 are not limited to use with retorted oil shale and can be readily adapted, by those skilled in the art, for use with other types of particulate matter requiring homogeneous mixing or mixing and cooling.

More particularly described, housing 12 comprises respective upper and lower housing sections 18 and 20. Connected to housing upper section 18 is a pipe stub 22 to which is connected a conduit 26 through which hot, retorted shale 10 is fed into apparatus 8. Shale 10 is received through conduit 26 from one or more oil shale retorts (not shown) and is typically at about the retorting temperature, which may, for example, be between 700° F. and about 1000° F. The retorted oil shale, which is typically crushed after mining to pieces no larger than about two inches across, may be fed into apparatus 8 through conduit 26 by gravity or by the use of powered augers, not shown.

A pipe section 30, to which pipe stub 22 is connected, is installed in housing upper section 18. Pipe section 30 discharges into a chamber 32 having a single inlet 34 and having an outlet comprising a plate 36 (FIG. 2) with openings therein for each one of the mixing tubes 14. Disposed within chamber 32, beneath inlet opening 34, is a conical flow diverter 38 which causes the flow of particulate shale discharged from pipe section 30 to flow outwardly for feeding into mixing tubes 14.

Figure 2:
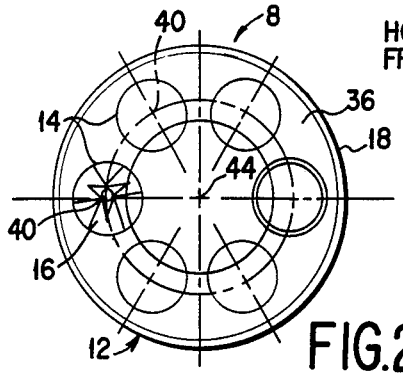
FIG. 2 is a transverse cross-sectional drawing taken along line 2—2 of FIG. 1, showing the use of six, circularly arranged mixing tubes.

By way of illustrative example, with no limitations intended or implied, an arrangement of six mixing tubes 14 is shown in FIGS. 1 and 2. The parallel axes 40 of these six mixing tubes lie on a common circle centered at a vertical axis 44 extending through apparatus 8. Generally, within reason, better shale mixing and cooling is provided by use of a number of mixing tubes 14, rather than by use of only a single mixing tube or by only a small number of mixing tubes of comparable cross-sectional area.

Mixed and cooled shale 10 is discharged, from the open lower ends of mixing tubes 14 into a conical, converging lower end region of housing lower section 20. The mixed and cooled shale 10 is discharged from housing section 20 through a bottom fitting 46 into a connecting pipe or conduit 48 which may, for example, transport the shale to a conveyor (not shown) for further transport to a disposal site.

Included in mixing tower apparatus 8 are liquid (water) cooling means 52 which provide cooling water from a source or supply (not shown) to mixing tubes 14, as described below. Cooling means 52 may also be connected for providing cooling water into housing chamber 32 for spraying onto the moving shale bed.

Figure 3:
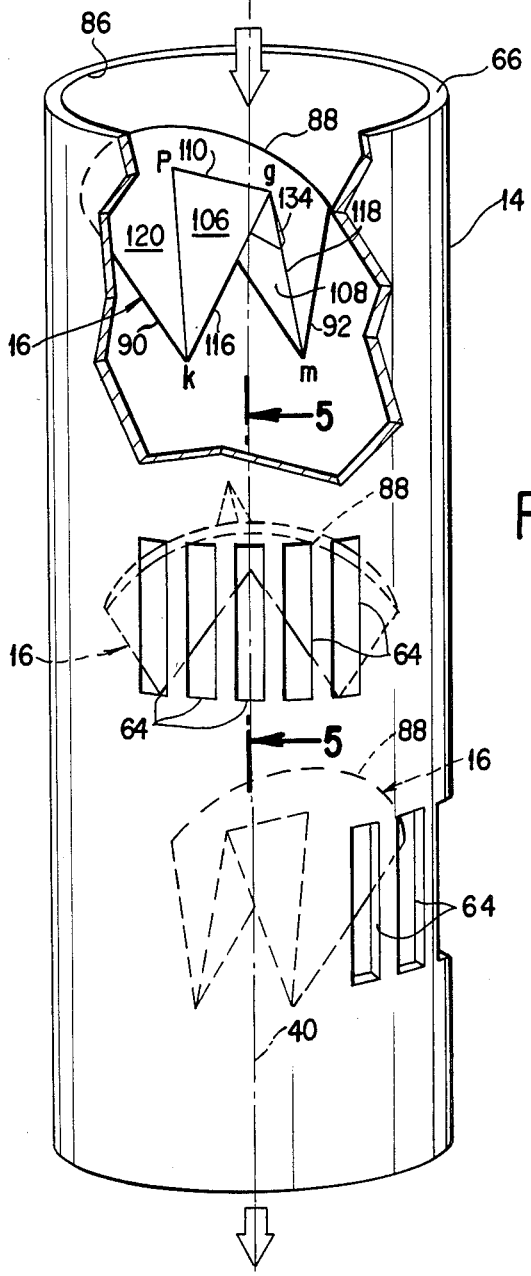
FIG. 3 is a partly cutaway drawing of a representative axial segment of one of the mixing tubes shown in FIG. 1, showing the arrangement therein of three mixing members of the present invention.

Mixing tubes 14 (FIGS. 1 and 3) are configured for causing the homogenous mixing of particulate shale 10 as the shale flows downwardly therethrough under gravity, the mixing being accomplished statically as opposed to the use of externally powered (i.e., mechanically agitated mixing apparatus. It is to be appreciated, however, that although mixing tubes 14 may be generally considered as static mixers, considerable dynamic mixing occurs therewithin. Therefore, the term "static mixing" as used herein means only that the mixing is accomplished without the application of external power. Within mixing tube 14, the mixing of particulate shale 10 is accomplished by mixing members 16, which are more particularly described below in conjunction with FIGS. 5–7.

The size of mixing tube 14 is typically determined by the type of particulate matter for which the mixing tube is to be used and upon the required or desired throughput rate and degree of mixing to be achieved. Axial length of mixing tube 14 is largely determined by the number of mixing members 16 mounted in the tube and the axial spacing between such members. Preferably, all mixing members 16 installed in a particular mixing tube are substantially identical; ordinarily, at least three mixing members are installed in each mixing tube. By way of example, FIG. 1 shows the use of six mixing members 16 in mixing tube 14.

To minimize the axial length of mixing tube 14, mixing members 16 are preferably axially separated from one another by a distance just sufficient to assure that none of the mixing members interfere with the particulate matter flow around the above or below adjacent mixing members. In that regard, during packed bed, gravity flow of particulate matter through mixing tube 14, a void 60 is formed just under each mixing member (FIG. 5). Defining each void 60 is a downwardly and rearwardly sloping particulate matter "repose" surface 62. If all the mixing members 16 within a mixing tube are uniform in size, shape and placement, all voids 60 and repose surfaces 62 can be expected to be similar in configuration. The present inventors have determined that undesirable interference between adjacent mixing members 16 can be avoided by axially separating the members such that each member is below the repose surface 62 associated with the above one of the members.

Cooling of the particulate matter flowing downwardly through tubes 14 is provided by liquid cooling means 52 which preferably sprays cooling water into one or more of voids 60 beneath mixing members 16 and onto the matter surface 62. Importantly, one or more apertures 64 are formed through tube wall 66 in the region of voids 60 to permit steam, caused by the cooling water contacting the hot particulate matter, to escape or disengage from the tubes.

Although, by way of example, a packed bed flow of particulate matter through tubes 14 is shown and described herein, it is to be understood that tubes 14 and mixing members 16 can also be used in other than packed bed systems, for example, in systems in which the particulate matter cascades downwardly through the tube from one mixing member to the next, in which case no repose surfaces 62 would ordinarily exist.

Figure 4:
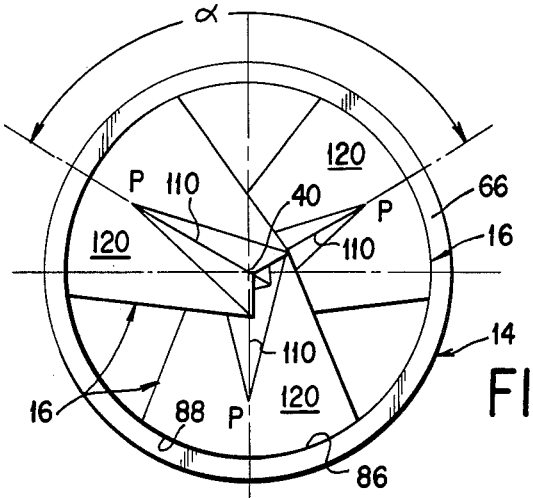
FIG. 4 is a view looking down into the top of the mixing tube segment of FIG. 3, showing features of the mixing members.

The present inventors have also determined that efficient particulate matter mixing in tube 14 is further enhanced by mounting mixing members 16 in the tube so that the members are rotationally offset from one another in a uniform manner, causing the members to lie along a helical path 68 (FIG. 1) around tube longitudinal axis 40. Preferably, a rotational offset angle, $\alpha$, (FIG. 4), between intersecting, centerline planes of adjacent mixing members 16 is between about 60° and about 120°. Also preferably, mixing members 16 are arranged in one or more groups of mixing members in which the offset angle, $\alpha$, between adjacent members is the same for each adjacent pair and the sum of all the offset angles for the group is equal to 360°. Accordingly, for any group of N mixing members 16, the rotational offset angle between adjacent mixing members is preferably equal to 360° divided by the number N. For the preferred offset angle range of between about 60° and 120°, it can be seen that the preferred number of mixing members per group is between three and six. A group of three mixing members is thus preferably arranged at 120° rotational intervals; whereas, a group of four members is preferably arranged at 90° rotational intervals. A group of six mixing members 16 may be arranged at 60° rotational intervals or may alternatively be divided into two sub-groups of three members each, the members in each such subgroup being arranged at 120° rotational intervals.

As shown in FIGS. 5–7, mixing member 16 is three dimensional in shape, comprising generally a flat, primary mixer element 80, a secondary mixer element 82 and a tertiary mixer element 84. Although primary mixer element 80 and secondary and tertiary mixer elements 82 and 86, respectively, are shown in FIG. 6 as separate pieces, it is to be appreciated that all three such pieces of mixer member 16 are joined together to form a single, rigid structure, as shown in FIG. 7. However, for purposes of describing mixer member 16, it is more convenient to consider primary, secondary and tertiary elements 80, 82 and 84 as separate parts. Mixing members 16 are mounted to an inner surface 86 of tube wall 58 with primary mixer element 80 at a downward slant angle "A." Preferably, slant angle "A" is between about 30° and about 60°, depending upon the physical characteristics of the particulate matter being mixed and cooled in tubes 14. Angle "A" may be about 40° for retorted oil shale.

Primary mixer element 80 is defined by a generally "W" shaped mixing edge and an arcuate, member mounting edge 88. The "W" shaped edge comprises a first outer edge 90, which extends from point "j" to point "k" (FIGS. 6 and 7), and an opposite outer edge 92, which extends from point "l" to point "m." First and second outer edges 90 and 92, respectively, converge at an outer edge converging angle "B" towards a point "o" outside of mixer plate 80. Angle "B" may, for example, be between about 30° and about 60°, and is preferably about 40°. Further comprising the "W" shaped edge of primary mixer element 80 are respective first and second inner edges 94 and 96 which converge, at an inner edge converging angle "C", to a point "p." First inner edge 94 extends between points "p" and "k" and second inner edge 96 extends between points "p" and "m." Angle "C" is typically between about 15° and about 45°, and is preferably about 25°.

Respective first outer and inner edges 90 and 94 intersect at point "k" at an outer-to-inner edge intersecting angle "D." Respective second outer and inner edges 92 and 96 intersect at point "m" at the same angle "D." Preferably, angle "D" is between about 20° and about 45°, with about 35° being the most preferred angle.

Arcuate edge region 88 of primary mixer plate 80 interconnects ends of first and second outer edges 90 and 92, respectively, extending between points "j" and "l," and is contoured to fit closely against mixer tube inner surface 86 when mixer member 16 is positioned against tube wall 66 at slant angle "A," the mixing member being connected to the tube wall as by welding along edge region 88. It will be understood, however, that is tube wall 66 is not round, primary mixer plate edge 88 may not necessarily be arcuate. For example, in the event the tube wall is square or elliptical, primary mixer plate edge will be linear or eliptical instead of curved.

Secondary mixer element 82 is formed generally in the shape of a tetrahedron having respective closed first and second sides 106 and 108 of triangular shape (FIGS. 6 and 7). Sides 106 and 108 are joined together along a first corresponding pair of edges to thereby form an elongate, linear peak or ridge 110 which extends from point "p" to point "q," point "p" of secondary member 82 corresponds to point "p" of primary mixer plate 80 (above described). A second corresponding pair of edges 112 and 114 of secondary mixer element sides 106 and 108 extend, respectively, between points "k" and "p" and points "m" and "p", all such points corresponding to the same lettered points on primary mixer element 80. Secondary mixer element edges 112 and 114 define an open bottom of the secondary element. A third corresponding pair of edges 116 and 118 of secondary mixer sides 106 and 108 extend, respectively, between points "k" and "q" and points "m" and "q," and define an open front or face of secondary mixer element 82.

First and second sides 106 and 108 of secondary mixer element 82 are angled relative to one another so that upon forming mixer member 16, second corresponding pair of edges 112 and 114 abut an upper surface 120 of primary mixer plate 80 along respective inner edges 94 and 96 thereof. Preferably, as shown in FIG. 5, secondary mixer element edges 112 and 114 extend the entire or substantially the entire length of primary mixer plate inner edges 94 and 96. As a result, secondary mixer element edges 116 and 118 connect with primary mixer plate outer edges 90 and 92 to form a non-planar edge on mixing member 16 which extends from point "j," through points "k," "q" and "m," to point "l." Edges 116 and 118, which form the open face of secondary mixer element 82, are preferably of such common length that when the secondary mixer element is joined in the above-described manner to upper surface 120 of primary mixer plate, peak 110 of the secondary element makes an obtuse peak-to-plate angle "K" with such upper surface of between about 120° and about 150° (FIG. 5). Linear peak 110 thereby also forms an Angle "E" with the plane of primary mixer element 80, such angle "E" being the supplementary angle to angle "K" (that is, the sum of angles "K" and "E" is equal to 180°). More preferably, angle "E" is about 40°. In any event, the sum of angle "E" and above-described angle "A" which primary mixer element 80 makes with tube wall 66 is preferably less than about 90°. As a consequence, linear peak 110 slants downwardly when mixing member 16 is installed in tube 14 at slant angle "A."

When mixing member 16 is installed in tube 14 in the above-described manner, the length so secondary mixer element peak 110 and of primary mixer element 80 along a mixing member centerline plane through points "p" and "q" and tube axis 40 are preferably such that the outer end of peak 110, at point "q," and the intersections between edges 90, 112 and 116, at point "k," and of edges 92, 96 and 114, at point "m," are located outwardly from tube inner surface 86 beyond tube axis 40. Such peak and plate lengths are also preferably such that secondary mixer element third side (defined by front edges 116 and 118) (FIG. 5), makes a side-to-axis angle "F" with tube axis 40 which may be between about +10° and about −10°.

Tertiary mixer element 84 is also of general tetrahedral shape, being shaped similarly to secondary mixer element 82, but substantially smaller.

Comprising tertiary mixer element 84 (FIGS. 6 and 7) are first and second closed sides 130 and 132 which are triangular shaped. Sides 130 and 132 are interconnected along a first corresponding pair of edges to form a linear peak 134 extend between points "q" and "r," point "q" corresponding to point "q" at the forward end of secondary mixer element linear peak 110. A second corresponding pair of edges 136 and 138 of tertiary mixer element sides 130 and 132 intersect at point "q" and define an open rear side of the tertiary element. A third corresponding pair of edges 140 and 142 of sides 130 and 132 intersect at point "r" and define an open, downwardly-facing, fourth side of the tertiary mixer element 84. Edges 136 and 138 extend, respectively, between points "q" and "s" and points "q" and "t," edges 140 and 142 extending, respectively, between points "r" and "s" and points "r" and "t."

Tertiary mixer element edges 136 and 138, defining the open rear side, are joined to respective secondary mixer element edges 116 and 118 at the intersection point "q" thereof so that tertiary mixer element projects forwardly from secondary mixer element 82, edges 136 and 138 having the same intersection angle as edges 116 and 118. Linear peaks 110 and 134 of respective secondary and tertiary mixer elements 82 and 84 meet at an obtuse peak-to-peak angle "G" at point "q" (FIG. 5). Preferably, angle "G" is between about 125° and about 145°, with 145° being more preferred.

With secondary and tertiary mixer elements 82 and 84 joined together in the above-described manner, a continuous peak, formed of peaks 110 and 134, extends from point "p" at primary mixer element 80, through point "q" to point "r." This continuous peak lies on the centerline plane (plane of symmetry) through mixing member 16 and importantly functions as a watershed to divide and sidewardly divert the particulate matter flowing downwardly onto the mixing member.

Tertiary mixing element 84 is shaped so that, as shown in FIG. 5, the downwardly facing open side thereof makes an acute side-to-peak angle "H" with peak 134. Angle "H" may be between about 30° and about 60°, with an angle of about 45° being preferred.

When primary mixer element 80, secondary mixer element 82 and tertiary mixer element 84 are joined together as described above, the secondary element projects upwardly from the primary mixer element and the tertiary mixer element projects forwardly from upper regions of the secondary element. Three pairs of free or mixing edges, all at different angles, are provided: primary mixer element outer edges 90 and 92 (extending from points "j" to "k" and "l" to "m"), portions of secondary mixer element forward edges 116 and 118 (extending from points "k" to "s" and "m" to "t") and tertiary mixer element lower edges 140 and 142 (extending from points "r" to "s" and "r" to "t").

By flowing initially segregated sections of different colored sand, as well as actual samples of hot, retorted oil shale, through mixer tube 14, in which a plurality of mixing members 16 are mounted in the above-described manner, the present inventors have determined that the described configuration of free edges 90, 92, 116, 118, 140 and 142, which extend a various angles around forward regions of the mixing member, provide excellent particulate matter mixing. Moreover, the location and angles of such free edges 90, 92, 116, 118, 140 and 142 are especially effective in imparting radial movement to the particulate matter as it flows downwardly over mixing members 16. This radial movement causes peripheral regions of the particulate matter to mix inwardly from tube wall 66 towards tube axis 40.

VARIATIONS OF FIGS. 8–11

Figure 8:
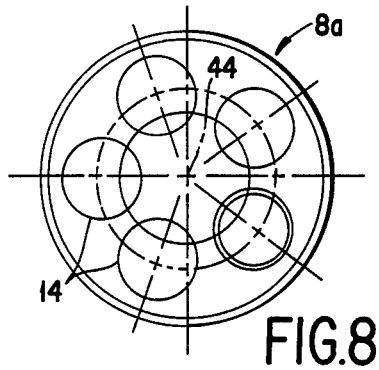
FIG. 8 is a transverse cross-sectional view similar to FIG. 2 showing a first variation shale shaft cooler having five circularly arranged mixing tubes.
Figure 9:
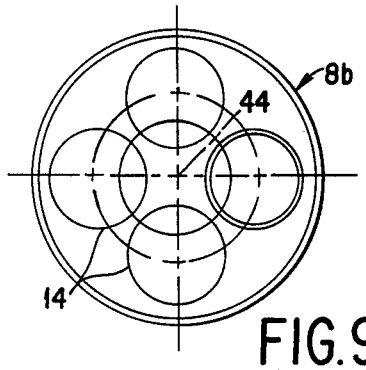
FIG. 9 is a transverse cross-sectional view similar to FIG. 2 showing a second variation shale shaft cooler having four circularly arranged mixing tubes.
Figure 10:
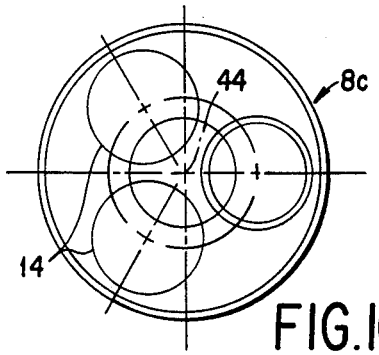
FIG. 10 is a transverse cross-sectional view similar to FIG. 2 showing a third variation shale shaft cooler having three circularly arranged mixing tubes.

Mixing apparatus 8 may, as shown in FIG. 2, comprise six mixing tubes 14 arranged in parallel on a common circle around apparatus longitudinal axis 44. A greater or lesser number of mixing tubes 14 may, however, alternatively be disposed in housing 12. For example, as shown in FIG. 8, five vertically oriented mixing tubes 14 may be circularly arranged about the longitudinal axis 44 of a first variation mixing apparatus 8a. Other than the use of five rather than six mixing tubes 14, apparatus 8a may be identical to apparatus 8 described above. Similarly, FIG. 9 illustrates the use of four mixing tubes 14 circularly arranged about the longitudinal axis 44 of a seocnd variation mixing apparatus 8*b* and FIG. 10 illustrates the use of only three circularly arranged mixing tubes 14 in a third variation mixing apparatus 8*c*.

Figure 11:
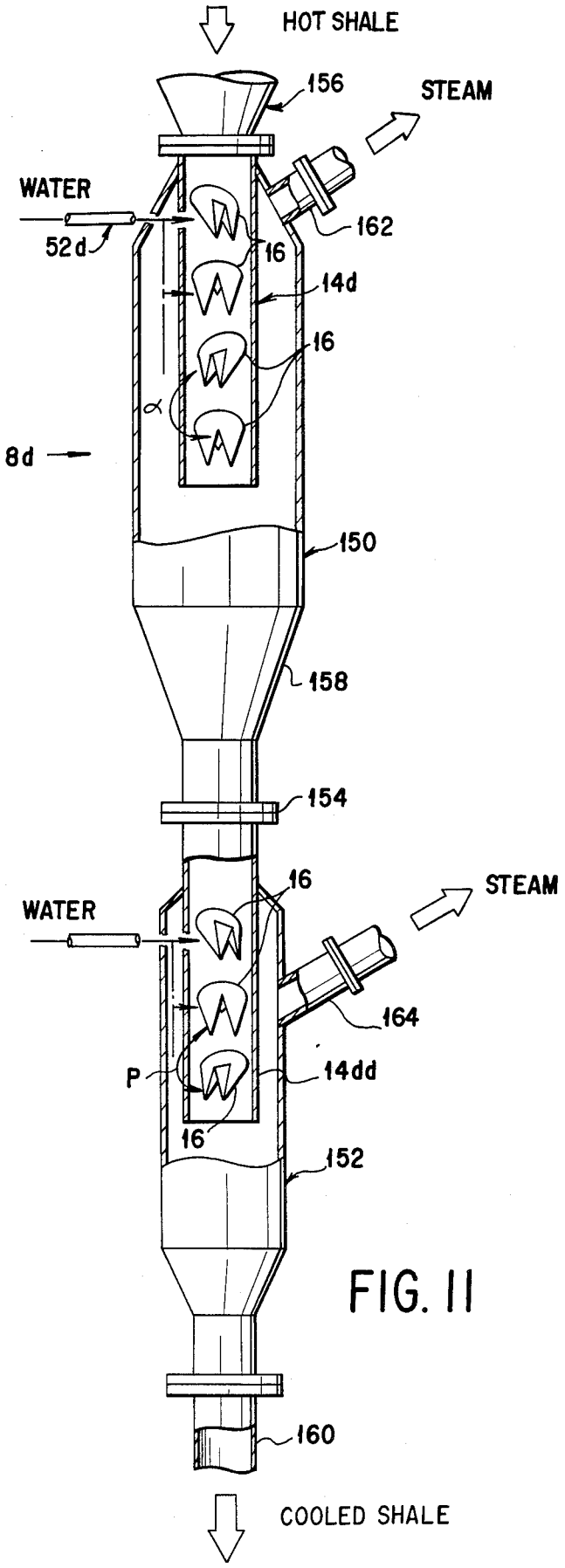
FIG. 11 is a cutaway drawing of an alternative arrangement of a mixing tube apparatus of the present invention, showing upper and lower sections of the tube, the upper section having four mixing members arranged at 90° rotational intervals and the lower section having three mixing members arranged at 120° rotational intervals.

A fourth variation mixing apparatus 8*d* is shown in FIG. 11. Mixing apparatus 8*d* illustrates the use of a series arrangement of mixing tubes and comprises an upper housing 150 and a lower housing 152 which are connected at a coupling 154. Axially mounted in upper housing 150 is an upper mixing tube 14*d* and a lower mixing tube 14*dd* is axially installed in lower housing 152. Both mixing tubes 14*d* and 14*dd* are similar to the above-described mixing tube 14 and are designated as the "d" and "dd" tubes to enable distinguishing therebetween. As shown in FIG. 11, upper mixing tube 14*d* has installed therein, at 90° rotation angles "$\alpha$", four mixing members 16; whereas, lower mixing tube 14*dd* has installed therein, at 120° rotational angles "$\beta$" only three mixing members. Particulate matter is fed into upper mixing tube 14*d* through a conduit 156 connected to the top of upper housing 150. After flowing downwardly through upper tube 14*d*, the initially mixed particulate matter is discharged into a conical bottom section 158 of the upper housing. From conical section 158, the particulate matter flows, under gravity, into lower mixing tube 14dd. The mixed particulate matter is discharged from lower mixing tube 14*dd* through a conduit 160 for disposal or to a next-in-sequence mixing stage (not shown).

Cooling means 52*d* (similar to cooling means 52) mkay be provided for cooling particulate matter flowed through apparatus 8*d*, in which case side conduits 162 and 164 are connected to respective upper and lower housings 150 and 152 to permit disengagement of steam from the particulate matter.

Although there have been described above specific arrangements of mixing or mixing/cooling apparatus for particulate matter, such as retorted oil shale, and mixing tubes and mixing members associated therewith, for the purpose of illustrating the manner in which the present invention may be used to advantage, it will be appreciated that the invention is not limited thereto. As an example, free (mixing) edges 90, 92, 116, 118, 140 and 142 of mixing member 16 are shown in FIGS. 5–7 as being linear; however, any or all of such free edges may be curved in either two or three dimensions. Similarly, either or both linear peaks 110 and 132 may be curved, rather than straight as shown. Also, primary mixer element 80 may be curved or even rippled instead of being flat as shown. First and second sides 106 and 108 of secondary mixer element 84 may also be curved rather than flat as shown. Member mounting edge region 88 may be shaped in any manner necessary to provide a close fit to mixing tube 14, regardless of cross-sectional shape of the tube. Moreover, outer-to-inner edge intersection angles "D" for each pair of outer and inner edges 90, 94 and 92, 96 of the "W" shaped edge of primary mixer element 80 are not necessarily equal as shown nor are side edges 112 and 114 of secondary mixer element 82 necessarily equal in length to primary mixer element inner edges 94 and 96.

Accordingly, any and all modifications and variations which may occur to those skilled in the relevant art should be considered to be within the scope and spirit of the invention as defined in the appended claims.

What is claimed is:

1. Mixing tower apparatus for the packed bed gravity flow mixing of particulate matter, said mixing tower apparatus comprising a plurality of mixing tube means, arranged around a circle in an equally spaced means, arranged around a circle in an equally spaced apart relationship, for mixing the particulate matter mounted with the longitudinal axes thereof mutually parallel, each of the mixing tube means comprising:

(a) an elongate mixing tube adapted for operation with the longitudinal axis thereof in a vertical orientation; and (b) mixing means disposed in said tube for causing the mixing of particulate matter flowing downwardly through the tube, said mixing means including a plurality of three-dimensional mixing members connected to the inside of the tube in an axially spaced apart and rotationally offset relationship to one another, each of the mixing members comprising:

(1) a primary mixer element having a generally "W" shaped free surface edge and a mounting edge interconnecting opposite ends of the "W" shaped edge, said primary mixer element being connected at a downward slant angle to the inside tube surface; and (2) a peaked, secondary mixer element of tetrahedral shape having closed first and second triangular sides and being open on the third and fourth sides, the first and second sides being interconnected to form a linear peak, edges of the first and second sides defining the open fourth side being joined to the primary mixer element along intersecting inner leg portions of said "W" shaped edge so as to cause the secondary mixer element to sit on top of the primary mixer element with said linear peak intersecting the upper surface of the primary mixer element at an obtuse peak-to-element angle.

2. Mixing tower apparatus for the packed bed gravity flow mixing of particulate matter, said mixing tower apparatus comprising a plurality of mixing tube means for mixing the particulate matter mounted with the longitudinal axes thereof mutually parallel, each of the mixing tube means comprising:

(a) an elongate mixing tube adapted for operation with the longitudinal axis thereof in a vertical orientation; and (b) mixing means disposed in said tube for causing the mixing of particulate matter flowing downwardly through the tube, said mixing means including a plurality of three-dimensional mixing members connected to the inside of the tube in an axially spaced apart and rotationally offset relationship to one another, each of the mixing members comprising:

(1) a primary mixer element having a generally "W" shaped free surface edge and a mounting edge interconnecting opposite ends of the "W" shaped edge, said primary mixer element being connected at a downward slant angle to the inside tube surface; and (2) a peaked, secondary mixer element of tetrahedral shape having closed first and second triangular sides and being open on the third and fourth sides, the first and second sides being interconnected to form a linear peak, edges of the first and second sides defining the open fourth side being joined to the primary mixer element along intersecting inner leg portions of said "W" shaped edge so as to cause the secondary mixer element to sit on top of the primary mixer element with said linear peak intersecting the upper surface of the primary mixer element at an obtuse peak-to-element angle;

the plurality of mixing members including at least one group of N members, each member of said group being rotationally offset from the above-adjacent one of the members in the group in a uniform rotational direction by a rotational angle "$\alpha$" which is equal to 360°/N, the members of said group being arranged along a helical path around the inside of the tube.

3. Static mixing tube apparatus for the packed bed gravity flow mixing of particulate matter, said mixing tube apparatus comprising:

(a) an elongate mixing tube adapted for operation with the longitudinal axis thereof in a vertical orientation; and (b) mixing means disposed in said tube for causing the mixing of particulate matter flowing downwardly through the tube, said mixing means including a plurality of three-dimensional mixing members connected to the inside of the tube in an axially spaced apart and rotationally offset relationship to one another, each of the mixing members comprising:

(1) a primary mixer element having a generally "W" shaped free surface edge and a mounting edge interconnecting opposite ends of the "W" shaped edge, said primary mixer element being connected at a downward slant angle to the inside tube surface; and (2) a peaked, secondary mixer element of general tetrahedral shape having closed first and second triangular sides and open third and fourth sides, the first and second sides being interconnected to form a linear peak and the edges of the first and second sides defining the open fourth side being joined to the primary mixer element along intersecting inner leg edges of said "W" shaped edge so as to cause the secondary mixer element to sit on top of the primary mixer element with the linear peak intersecting the primary mixer element at an obtuse peak-to-element angle;

the plurality of mixing members including at least one group of N members, each member of said group being rotationally offset from the above-adjacent one of the members in the group in a uniform rotational direction by a rotational angle "$\alpha$" which is equal to 360°/N, the members of said group being arranged along a helical path around the inside of the tube.

4. The apparatus as claimed in claim 2 or 3 wherein the number N is between 3 and 6.

5. The apparatus as claimed in claims 2 or 3 wherein the plurality of mixing members includes at least one second group of M members, each member of said second group being rotationally offset from the above-adjacent member in the same group by a rotational angle "$\beta$" which is equal to 360°/M, the members of said second group being arranged along a second helical path around the inside of the tube beneath the helical path along which the group of N members is arranged.

6. The apparatus as claimed in claim 5 wherein the number M is between 3 and 6.

7. Mixing tower apparatus for the packed bed gravity flow mixing of particulate matter, said mixing tower apparatus comprising a plurality of mixing tube means for mixing the particulate matter mounted with the longitudial axes thereof mutually parallel, each of the mixing tube means comprising:

(a) an elongate mixing tube adapted for operation with the longitudinal axis thereof in a vertical orientation;

(b) mixing means disposed in said tube for causing the mixing of particulate matter flowing downwardly through the tube, said mixing means including a plurality of three-dimensional mixing members connected to the inside of the tube in an axially spaced apart and rotationally offset relationship to one another, each of the mixing members comprising:

(1) a primary mixer element having a generally "W" shaped free surface edge and a mounting edge interconnecting opposite ends of the "W" shaped edge, said primary mixer element being connected at a downward slant angle to the inside tube surface; and (2) a peaked, secondary mixer element of tetrahedral shape having closed first and second triangular sides and being open on the third and fourth sides, the first and second sides being interconnected to form a linear peak, edges of the first and second sides defining the open fourth side being joined to the primary mixer element along intersecting inner leg portions of said "W" shaped edge so as to cause the secondary mixer element to sit on top of the primary mixer element with said linear peak intersecting the upper surface of the primary mixer element at an obtuse peak-to-element angle; and (c) means for introducing a cooling fluid into the tube for mixing with the particulate matter flowing downwardly through the tube.

8. Static mixing tube apparatus for the packed bed gravity flow mixing of particulate matter, said mixing tube apparatus comprising:

(a) an elongate mixing tube adapted for operation with the longitudinal axis thereof in a vertical orientation;

(b) mixing means disposed in said tube for causing the mixing of particulate matter flowing downwardly through the tube, said mixing means including a plurality of three-dimensional mixing members connected to the inside of the tube in an axially spaced apart and rotationally offset relationship to one another, each of the mixing members comprising:

(1) a primary mixer element having a generally "W" shaped free surface edge and a mounting edge interconnecting opposite ends of the "W" shaped edge, said primary mixer element being connected at a downward slant angle to the inside tube surface; and (2) a peaked, secondary mixer element of general tetrahedral shape having closed first and second triangular sides and open third and fourth sides, the first and second sides being interconnected to form a linear peak and the edges of the first and second sides defining the open fourth side being joined to the primary mixer element along intersecting inner leg edges of said "W" shaped edge so as to cause the secondary mixer element to sit on top of the primary mixer element with the linear peak intersecting the primary mixer element at an obtuse peak-to-element angle; and (c) means for introducing a cooling fluid into the tube for mixing with the particulate matter flowing downwardly through the tube.

9. The apparatus as claimed in claims 7 or 8 wherein the flow of particulate matter through the tubes is a packed bed flow, a particulate matter repose surface being formed under each mixing member and wherein the means for introducing cooling fluid into the tube introduces the fluid through the side wall of the tube below adjacent to at least one of the mixing members and above the particulate matter repose surface associated therewith.

10. The apparatus as claimed in claim 9 wherein the particulate matter is hot retorted oil shale having a temperature in excess of about 500° F. at the upper end of the tube and wherein said cooling fluid is water, and including means enabling the disengagement of steam caused, by the water contacting the hot shale, from the shale.

11. The apparatus as claimed in claim 10 wherein said disengaging means include at least one aperture through a side wall of the tube for the escape of steam therefrom, said aperture being located below adjacent at least one of the mixing members and above the shale surface of repose associated with the mixing member.

12. Mixing tower apparatus for the packed bed gravity flow mixing of particulate matter, said mixing tower apparatus comprising a plurality of mixing tube means for mixing the particulate matter mounted with the longitudinal axes thereof mutually parallel, each of the mixing tube means comprising:

(a) an elongate mixing tube adapted for operation with the longitudinal axis thereof in a vertical orientation; and (b) mixing means disposed in said tube for causing the mixing of particulate matter flowing downwardly through the tube, said mixing means including a plurality of three-dimensional mixing members connected to the inside of the tube in an axially spaced apart and rotationally offset relationship to one another, each of the mixing members comprising:

(1) a primary mixer element having a generally "W" shaped free surface edge and a mounting edge interconnecting opposite ends of the "W" shaped edge, said primary mixer element being connected at a downward slant angle to the inside tube surface; and (2) a peaked, secondary mixer element of tetrahedral shape having closed first and second triangular sides and being open on the third and fourth sides, the first and second sides being interconnected to form a linear peak, edges of the first and second sides defining the open fourth side being joined to the primary mixer element along intersecting inner leg portions of said "W" shaped edge so as to cause the secondary mixer element to sit on top of the primary mixer element with said linear peak intersecting the upper surface of the primary mixer element at an obtuse peak-to-element angle, the linear peak of the secondary mixer element extending inwardly from the primary mixer element beyond the longitudinal axis of the tube.

13. Mixing tower apparatus for the packed bed gravity flow mixing of particulate matter, said mixing tower apparatus comprising a plurality of mixing tube means for mixing the particulate matter mounted with the longitudinal axes thereof mutually parallel, each of the mixing tube means comprising:

(a) an elongate mixing the adapted for operation with the longitudinal axis thereof in a vertical orientation; and (b) mixing means disposed in said tube for causing the mixing of particulate matter flowing downwardly through the tube, said mixing means including a plurality of three-dimensional mixing members connected to the inside of the tube in an axially spaced apart and rotationally offset relationship to one another, each of the mixing members comprising:

(1) a primary mixer element having a generally "W" shaped free surface edge and a mounting edge interconnecting opposite ends of the "W" shaped edge, said primary mixer element being connected at a downward slant angle to the inside tube surface;

(2) a peaked, secondary mixer element of tetrahedral shape having closed first and second triangular sides and being open on the third and fourth sides, the first and second sides being interconnected to form a linear peak, edges of the first and second sides defining the open fourth side being joined to the primary mixer element along intersecting inner leg portions of said "W" shaped edge so as to cause the secondary mixer element to sit on top of the primary mixer element with said linear peak intersecting the upper surface of the primary mixer element at an obtuse peak-to-element angle; and (3) a peaked, tertiary mixer element of tetrahedral shape, said tertiary mixer element being substantially smaller than the secondary mixer element and having closed first and second sides and open third and fourth sides, the first and second sides of the tertiary mixer element being interconnected to form a linear peak and being connected at said open fourth side to the secondary mixer element at the peak and along the first and second side edges of the open third side of the secondary mixer element so as to cause the tertiary mixer element to project outwardly from the secondary mixer element open third side and the tertiary mixer element linear peak to intersect the secondary mixer element linear peak at a peak-to-peak intersection angle which is greater than about 90°.

14. Static mixing tube apparatus for the packed bed gravity flow mixing of particulate matter, said mixing tube apparatus comprising:

(a) an elongate mixing tube adapted for operation with the longitudinal axis thereof in a vertical orientation; and (b) mixing means disposed in said tube for causing the mixing of particulate matter flowing downwardly through the tube, said mixing means including a plurality of three-dimensional mixing members connected to the inside of the tube in an axially spaced apart and rotationally offset relationship to one another, each of the mixing members comprising:

(1) a primary mixer element having a generally "W" shaped free surface edge and a mounting edge interconnecting opposite ends of the "W" shaped edge, said primary mixer element being connected at a downward slant angle to the inside tube surface;

(2) a peaked, secondary mixer element of general tetrahedral shape having closed first and second triangular sides and open third and fourth sides, the first and second sides being interconnected to form a linear peak and the edges of the first and second sides defining the open fourth side being joined to the primary mixer element along intersecting inner leg edges of said "W" shaped edge so as to cause the secondary mixer element to sit on top of the primary mixer element with the linear peak intersecting the primary mixer element at an obtuse peak-to-element angle; and (3) a peaked, tertiary mixer element of tetrahedral shape, said tertiary mixer element being substantially smaller than the secondary mixer element and having closed first and second sides and open third and fourth sides, the first and second sides of the tertiary mixer element being interconnected to form a linear peak and being connected at said open fourth side to the secondary mixer element at the peak and along the first and second side edges of the open third side of the secondary mixer element so as to cause the tertiary mixer element to project outwardly from the secondary mixer element open third side and the tertiary mixer element linear peak to intersect the secondary mixer element linear peak at a peak-to-peak intersection angle which is greater than about 90°.

15. Static mixing apparatus for mounting in the flow path of particulate matter inside of a packed bed gravity flow mixing tube, said mixing apparatus comprising a mixing member which, in turn, comprises:

(a) a primary mixer element having a generally "W" shaped free surface edge and an attachment edge interconnecting opposite ends of the "W" shaped edge;

(b) a peaked, secondary mixer element of tetrahedral shape having closed first and second triangular sides and being open on the third and fourth sides, the first and second sides being interconnected to form a linear peak and edges of the first and second sides defining the open fourth side being joined to the primary mixer element along intersecting inner leg portions of said "W" shaped edge so as to cause the secondary mixer element to sit on top of the primary mixer element with said linear peak intersecting the upper surface of the primary mixer element at an obtuse peak-to-element angle; and (c) a peaked, tertiary mixer element of tetrahedral shape, said tertiary mixer element being substantially smaller than the secondary mixer element and having closed first and second sides and open third and fourth sides, the first and second sides of the tertiary mixer element being interconnected to form a linear peak and being connected at said open fourth side to the secondary mixer element at the peak and along the first and second side edges of the open third side of the secondary mixer element so as to cause the tertiary mixer element to project outwardly from the secondary mixer element open third side and the tertiary mixer element linear peak to intersect the secondary mixer element linear peak at a peak-to-peak intersection angle which is greater than about 90°.

16. The apparatus as claimed in claim 13, 14 and 15 wherein the peak-to-peak intersection angle between the linear peaks of the secondary and tertiary mixer elments is between about 125° and about 145°.

17. The apparatus as claimed in claim 16 wherein the peak-to-peak intersection angle is about 135°.

18. The apparatus as claimed in claim 13, 14 or 15 wherein the length of the tertiary mixer element linear peak is between about 30% and about 50% of the length of the secondary mixer element linear peak.

19. The apparatus as claimed in claims 13, 14 or 15 wherein the length of the tertiary mixer element linear peak is about 40% of the length of the secondary mixer element linear peak.

20. The apparatus as claimed in claims 13, 14 or 15 wherein edges of the tertiary mixer element first and second sides which define the open third side of the tertiary mixer element make an acute, side-to-peak angle of between about 30° and about 60° with the tertiary mixer element linear peak.

21. The apparatus as claimed in claim 20 wherein the side-to-peak angle is about 45°.

22. Static mixing member for mounting in the flow path of particulate matter inside of packed bed gravity flow mixing tube, said mixing member comprising:

(a) a primary mixer element having a generally "W" shaped free surface edge and a tube attachment edge interconnecting opposite ends of the "W" shaped edge, inner edges of the "W" shaped edge intersecting one another at an acute, inner edge angle;

(b) a peaked, secondary mixer element of tetrahedral shape having closed first and second triangular sides and being open on the third and fourth sides, the first and second sides being interconnected to form a linear peak, edges of said first and second sides defining the open fourth side being joined to the primary mixer element along intersecting inner edges of the "W" shaped edge so as to cause the secondary mixer element to sit on top of the primary mixer element and said linear peak to intersect the upper surface of the primary mixer element at an obtuse peak-to-element angle; and, (c) a peaked tertiary mixer element of tetrahedral shape, said tertiary mixer member being substantially smaller than the secondary mixer element and having closed first and second sides and open third and fourth sides, the first and second sides of the tertiary mixer element being interconnected to form a linear peak, edges of the tertiary mixer element first and second sides defining said open fourth side of the tertiary mixer element being joined to edges of the secondary mixer element first and second sides which define the open third side of the secondary mixer element, at the intersection thereof, in a manner causing the tertiary mixer element to project outwardly from the secondary mixer element at the peak line thereof and the tertiary mixer element linear peak to intersect the secondary mixer element linear peak at a peak-to-peak angle which is greater than about 90°.

23. Mixing tower apparatus for the packed bed gravity flow mixing of particulate matter, said mixing tower apparatus comprising a plurality of mixing tube means for mixing the particulate matter mounted with the longitudinal axes thereof mutually parallel, each of the mixing tube means comprising:

(a) an elongate mixing tube adapted for operation with the longitudinal axis thereof in a vertical orientation; and (b) mixing means disposed in said tube for causing the mixing of particulate matter flowing downwardly through the tube, said mixing means including a plurality of three-dimensional mixing members connected to the inside of the tube in an axially spaced apart and rotationally offset relationship to one another, each of the mixing members comprising:

(1) a primary mixer element having a generally "W" shaped free surface edge and a mounting edge interconnecting opposite ends of the "W" shaped edge, the outer edges of the "W" shaped edge of the primary mixer element converging towards one another in an outer edge converging angle of between about 30° and about 60°, said primary mixer element being connected at a downward slant angle to the inside tube surface; and (2) a peaked, secondary mixer element of tetrahedral shape having closed first and second triangular sides and being open on the third and fourth sides, the first and second sides being interconnected to form a linear peak, edges of the first and second sides defining the open fourth side being joined to the primary mixer element along intersecting inner leg portions of said "W" shaped edge so as to cause the secondary mixer element to sit on top of the primary mixer element with said linear peak intersecting the upper surface of the primary mixer element at an obtuse peak-to-element angle.

24. Static mixing tube apparatus for the packed bed gravity flow mixing of particulate matter, said mixing tube apparatus comprising:

(a) an elongate mixing tube adapted for operation with the longitudinal axis thereof in a vertical orientation; and (b) mixing means disposed in said tube for causing the mixing of particulate matter flowing downwardly through the tube, said mixing means including a plurality of three-dimensional mixing members connected to the inside of the tube in an axially spaced apart and rotationally offset relationship to one another, each of the mixing members comprising:

(1) a primary mixer element having a generally "W" shaped free surface edge and a mounting edge interconnecting opposite ends of the "W" shaped edge, the outer edges of said "W" shaped edge converging towards one another in an outer edge converging angle of between about 30° and about 60°, said primary mixer element being connected at a downward slant angle to the inside tube surface; and (2) a peaked, secondary mixer element of general tetrahedral shape having closed first and second triangular sides and open third and fourth sides, the first and second sides being interconnected to form a linear peak and the edges of the first and second sides defining the open fourth side being joined to the primary mixer element along intersecting inner leg edges of said "W" shaped edge so as to cause the secondary mixer element to sit on top of the primary mixer element with the linear peak intersecting the primary mixer element at an obtuse peak-to-element angle.

25. Static mixing apparatus for mounting in the flow path of particulate matter inside of a packed bed gravity flow mixing tube, said mixing apparatus comprising a mixing member which, in turn, comprises:

(a) a primary mixer element having a generally "W" shaped free surface edge and an attachment edge interconnecting opposite ends of the "W" shaped edge, the outer edges of said "W" shaped edge converging towards one another in an outer edge converging angle of between about 30° and about 60°; and (b) a peaked, secondary mixer element of tetrahedral shape having closed first and second triangular sides and being open on the third and fourth sides, the first and second sides being interconnected to form a linear peak and edges of the first and second sides defining the open fourth side being joined to the primary mixer element along intersecting inner leg portions of said "W" shaped edge so as to cause the secondary mixer element to sit on top of the primary mixer element with said linear peak intersecting the upper surface of the primary mixer element at an obtuse peak-to-element angle.

26. The static mixing member as claimed in claim 22 wherein:

(a) the peak-to-element angle is between about 120° and about 150°;

(b) the inner edge angle is between about 15° and about 45°; and (c) the peak-to-peak angle is between about 125° and about 145°.

27. The static mixing member as claimed in claim 26, wherein:

(a) the peak-to-element angle is about 140°;

(b) the inner edge angle is about 25°; and (c) the peak-to-peak angle is about 135°.

28. The apparatus as claimed in claim 22 wherein the outer edges of the "W" shaped edge of the primary mixer element intersect the inner edges of said "W" shaped edge at an acute outer-to-inner edge intersection angle which is between about 20° and about 45° and wherein edges of the tertiary mixer element first and second sides which define the open third side of the tertiary mixer element make an acute side-to-peak angle of between about 30° and about 60° with the tertiary mixer between linear peak.

29. The static mixing member as claimed in claim 28 wherein:

(a) the outer-to-inner angle is about 35°; and (b) the side-to-peak angle is about 45°.

30. The apparatus as claimed in claim 22 wherein the length of the tertiary mixer element linear peak is between about 30% and about 50% of the length of the secondary mixer element linear peak.

31. The apparatus as claimed in claim 30 wherein the length of the tertiary mixer element linear peak is about 40% of the length of the secondary mixer element linear peak.

32. The apparatus as claimed in claim 22 wherein the outer edges of the "W" shaped edge of the primary mixer element converge towards one another in an outer edge converging angle of between about 30° and about 60°.

33. The apparatus as claimed in claims 32, 23, 24 or 25 wherein the angle outer edge converging angle is about 40°.

34. A method for the packed bed gravity flow mixing of particulate matter, the method comprising the steps of:

(a) forming a plurality of primary mixer elements, each of said primary mixer elements having a generally "W" shaped free surface edge and a mounting edge interconnecting opposite ends of the "W" shaped edge;

(b) forming a plurality of peaked, secondary mixer elements of general tetrahedral shape, each of said secondary mixer elements having closed first and second triangular sides and open third and fourth sides, the first and second sides being interconnected to form a linear peak with the edges of the first and second sides defining the open fourth side;

(c) joining the edges of the first and second sides of each one of the secondary mixer elements to a corresponding one of the primary mixer elements along intersecting inner leg edges of the "W" shaped edge so as to cause the secondary mixer element to sit on top of the primary mixer element with the linear peak intersecting the primary mixer element at an obtuse peak-to-element angle, thereby forming a plurality of three-dimensional mixing members;

(d) forming an elongate mixing tube adapted for operation with the longitudinal axis thereof in a vertical orientation;

(e) connecting the plurality of mixing members to the inside of the mixing tube spaced apart along the tube longitudinal axis, said members being rotationally offset relative to one another, with the primary mixer element of each of the mixing members being connected to the tube at a preestablished downward slant angle; and (f) flowing particulate matter downwardly through the mixing tube in a packed bed flow past each of the mixing members in series.

35. A method for mixing and cooling hot, retorted, particulate oil shale which comprises the steps of:

(a) forming a plurality of primary mixer elements, each of said primary mixer elements having a generally "W" shaped free surface edge and a mounting edge interconnecting opposite ends of the "W" shaped edge;

(b) forming a plurality of peaked, secondary mixer elements of general tetrahedral shape, each of said secondary mixer elements having closed first and second triangular sides and open third and fourth sides, the first and second sides being interconnected to form a linear peak with the edges of the first and second sides defining the open fourth side;

(c) joining the edges of the first and second sides of each one of the secondary mixer elements to a corresponding one of the primary mixer elements along intersecting inner leg edges of the "W" shaped edge so as to cause the secondary mixer element to sit on top of the primary mixer element with the linear peak intersecting the primary mixer element at an obtuse peak-to-element angle, thereby forming a plurality of three-dimensional mixing members;

(d) forming an elongate mixing tube adapted for operation with the longitudinal axis thereof in a vertical orientation;

(e) connecting the plurality of mixing members to the inside of the mixing tube spaced apart along the tube longitudinal axis, the mixing members being rotationally offset relative to one another, with the primary mixer element of each of the mixing members being connected to the tube at a preestablished downward slant angle;

(f) orienting said mixing tube in a substantially vertical position; and (g) flowing hot, particulate retorted shale downwardly through the mixing tube in a packed bed flow past all of the mixing members in series.

36. The method as claimed in claim 34 or 35 wherein the step of connecting the mixing members to the inside of the mixing tube includes connecting a number N of the mixing members at rotational offset angles equal to about 360°/N, the N mixing members being thereby connected to the inside of the tube along a helical path.

37. The method as claimed in claim 36 wherein the step of connecting the mixing members to the inside of the mixing tube includes connecting an additional number M of mixing members to the inside of the mixing tube at rotational offset angles equal to about 360°/M, the additional M mixing members being thereby connected to the inside of the tube along a second helical path.

38. The method as claimed in claim 34 or 35 wherein the step of forming the primary mixer elements includes forming said primary elements so that when the mixing members are connected to the inside of the mixing tube at said preestablished slant angle, portions of the "W" shaped edge extend more than halfway across the tube.

39. The method as claimed in claim 34 or 35 wherein the slant angle is between about 30° and about 60°.

40. The method as claimed in claims 34 or 35 including the step of forming a plurality of tertiary mixer elements of tetrahedral shape, each of said tertiary mixer elements being substantially smaller in size than said secondary mixer elements and having closed first and second sides, the first and second side of each of the tertiary mixer elements being interconnected to form a linear peak, and further including the step of connecting each one of the tertiary mixer elements to a corresponding one of the secondary mixer elements at the peak thereof and along first and second side edges of the open third side of said corresponding secondary mixer element so as to cause the tertiary mixer element to project outwardly from said corresponding secondary mixer element open third side and so that the tertiary element linear peak intersects the linear peak of the corresponding secondary mixer element at a peak-to-peak angle which is greater than about 90°.

41. The method as claimed in claim 40 wherein the secondary and tertiary mixer elements are formed so that the linear peak of each of the tertiary elements is between about 30% and about 50% of the length of the linear peak of the corresponding secondary element to which the tertiary element is connected.

42. The method as claimed in claim 34 or 35 wherein outer edges of the "W" shaped edge of the primary mixer element intersect inner edges of the "W" shaped edge at an acute outer-to inner edge intersection angle of between about 20° and about 45° and wherein edges of the tertiary mixer element first and second sides which define the third open side of said tertiary mixer element make an acute angle of between about 30° and about 60° with the tertiary mixer element linear peak.

43. The method as claimed in claims 34 or 35 wherein outer edges of the "W" shaped edge of the primary mixer element coverage towards one another in an outer edge converging angle of between about 30° and about 60°.

44. The method as claimed in claims 34 or 35 including the step of introducing a cooling fluid into the mixing tube below adjacent to to at least one of the mixing members and above the particulate matter repose surface associated therewith.

45. Static mixing tube apparatus for the packed bed gravity flow mixing of particulate matter, said mixing tube apparatus comprising:

(a) an elongate mixing tube adapted for operation with the longitudinal axis thereof in a vertical orientation; and (b) mixing means disposed in said tube for causing the mixing of particulate matter flowing downwardly through the tube, said mixing means including a plurality of three dimensional mixing members connected to the inside of the tube in an axially spaced apart and rotationally offset relationship to one another, each of the mixing members comprising:

(1) a primary mixer element having a generally "W" shaped free surface edge and a mounting edge interconnecting opposite ends of the "W" shaped edge, said primary mixer element being connected at a downward slant angle to the inside tube surface; and (2) a peaked, secondary mixer element of general tetrahedral shape having closed first and second triangular sides and open third and fourth sides, the first and second sides being interconnected to form a linear peak and the edges of the first and second sides defining the open fourth side being joined to the primary mixer element along intersecting inner leg edges of said "W" shaped edge so as to cause the secondary mixer element to sit on top of the primary mixer element with the linear peak intersecting the primary mixer element at an obtuse peak-to-element angle, the linear peak of the secondary mixer element extending inwardly from the primary mixer element beyond the longitudinal axis of the tube.

* * * * *

UNITED STATES PATENT AND TRADEMARK OFFICE

CERTIFICATE OF CORRECTION

PATENT NO. : 4,813,788

DATED : March 21, 1989

INVENTOR(S) : Chien-Cheng Shih, Darcel L. Hulse, Walter Albertson

It is certified that error appears in the above-identified patent and that said Letters Patent is hereby corrected as shown below:

Column 13, line 9, delete entire line.

Column 15, line 11, correct "longitudial" to --longitudinal--.

Column 17, line 12, change "the" to --tube--.

Column 19, line 31, after "of" (second occurrence) insert --a--.

Column 21, line 53, change "between" to --element--.

Signed and Sealed this

Fifth Day of June, 1990

*Attest:*

HARRY F. MANBECK, JR.

*Attesting Officer*

*Commissioner of Patents and Trademarks*